United States Patent [19]

Fukukura

[11] Patent Number: 4,492,838

[45] Date of Patent: Jan. 8, 1985

[54] KEY SWITCH HAVING AN ACTUATOR INTEGRAL WITH THE RETURN SPRING

[75] Inventor: Kazutoyo Fukukura, Reading, Mass.

[73] Assignee: AMP Incorporated, Harrisburg, Pa.

[21] Appl. No.: 469,331

[22] Filed: Feb. 24, 1983

[51] Int. Cl.[3] ..... H01H 1/06

[52] U.S. Cl. ..... 200/159 A; 200/276; 200/159 B

[58] Field of Search ..... 200/159 A, 159 B, 276

[56] References Cited

U.S. PATENT DOCUMENTS

| | | | |
|---|---|---|---|
| 3,600,528 | 8/1971 | Leposavic | 200/159 B |
| 3,603,756 | 9/1971 | Carpentier et al. | 200/159 B |
| 3,773,997 | 11/1973 | Evans et al. | 200/159 B |
| 3,819,882 | 6/1974 | Anderson et al. | 200/159 A |
| 3,856,998 | 12/1974 | Sims, Jr. | 200/5 A |
| 3,888,807 | 6/1975 | Lockard | 200/16 R |
| 3,909,564 | 9/1975 | Scheingold et al. | 200/5 E |
| 3,928,736 | 12/1975 | Drage | 200/159 A |
| 4,063,054 | 12/1977 | Hirata | 200/159 R |
| 4,092,503 | 5/1978 | Raeder | 200/159 A X |
| 4,117,292 | 9/1978 | Hayes et al. | 200/340 |
| 4,370,533 | 1/1983 | Kamei et al. | 200/159 A |

FOREIGN PATENT DOCUMENTS

| | | | |
|---|---|---|---|
| 0087369 | 8/1983 | European Pat. Off. . | |
| 2046612 | 4/1971 | Fed. Rep. of Germany | 200/159 B |
| 2657783 | 7/1977 | Fed. Rep. of Germany | 200/5 A |
| 2705756 | 8/1978 | Fed. Rep. of Germany | 200/159 A |
| 2660067 | 3/1980 | Fed. Rep. of Germany . | |
| 7418436 | 12/1974 | France | 200/5 A |
| 2088131 | 6/1982 | United Kingdom | 200/159 A |

*Primary Examiner*—John W. Shepperd
*Assistant Examiner*—Renee S. Kidorf
*Attorney, Agent, or Firm*—F. W. Raring

[57] ABSTRACT

Key switch assembly comprises a frame and a plunger in the frame which is movable from an extended position to a depressed position to close a switch. A one piece member is provided which serves as both a return spring for the plunger and an actuator for closing the switch when the plunger is depressed. The one piece member has a force-receiving portion which is against the end of the plunger. The return spring and the actuator are integral with, and extend from, the force-receiving portion.

6 Claims, 4 Drawing Figures

42
44
44
46
22
40
38
36
28
20
26
52
48
2
50
30
32
32
30
24
54
58
62
74
72
68
60
56
63
66
64
34
19
4
8
14
6

KEY SWITCH HAVING AN ACTUATOR INTEGRAL WITH THE RETURN SPRING

BACKGROUND OF THE INVENTION

This invention relates to a key switch assembly of the type comprising a plunger mounted in a frame, a return spring which biases the plunger in extended position, and an actuator which, upon depression of the plunger, is moved against a contact zone to change the condition of a switch associated with the assembly. The invention is particularly directed to the simplification of the key switch assembly by the use of a single member which serves as both a return spring and an actuator.

FIELD OF THE INVENTION

A commonly used type of key switch assembly comprises a housing which is mounted adjacent to a switch having a plunger therein which can be depressed to close the switch. A conventional assembly has a spring, often a coil spring, which biases the plunger to its extended position and which is flexed when the plunger is depressed. An actuator is also provided which moves against a contact zone of the switch in response to movement of the plunger and which brings about the closure of the switch. The actuator is often a coil spring having a smaller diameter than the return spring which is positioned between the end of the plunger and the contact zone of the switch.

Switch assemblies of the type described above are widely used on keyboards and in use have been proved to be highly satisfactory. The manufacture of such keyboards, however, is complicated by the fact that two separate parts are provided in each assembly and must be positioned in each assembly on a keyboard when the parts are brought together in the manufacturing process. This fact contributes materially to the overall manufacturing costs of keyboards.

The present invention is directed to the achievement of a one piece member which serves as both a return spring and as an actuator and which can be easily assembled to the frame and the plunger in the manufacturing process.

A key switch assembly in accordance with the invention is of the type comprising a plunger, a return spring, and an actuator. The plunger is movable from an extended position to a depressed position with accompanying flexure of the return spring. The actuator is normally spaced from a switch contact zone and is movable against the contact zone is response to movement of the plunger from the extended position to the depressed position thereby to change the condition of the switch. The return spring is effective to return the plunger to the extended position with accompanying movement of the actuator away from the contact zone. The key switch assembly is characterized in that the return spring and the actuator are provided as a one piece member, the one piece member having a force-receiving portion which is in engagement with the plunger for movement with the plunger between the extended position and the depressed position. The return spring and the actuator extend away from the force-receiving portion in the direction of movement of the plunger from the extended position to the depressed position. The return spring has a reaction portion which bears against a fixed support that is proximate to the switch contact zone and the actuator has a contact portion which is engageable with the switch contact zone. The reaction portion is spaced from the plunger by a distance which is greater than the distance between the plunger and the contact portion whereby upon movement of the plunger from the extended position to the depressed position, the return spring is resiliently flexed and the contact portion of the actuator is moved against the contact zone thereby to change the condition of the switch.

In accordance with a further embodiment, the one piece member is of spring metal and is separate from the plunger. The plunger has a leading end, the force-receiving portion of the one piece member being against the leading end of the plunger. In accordance with a further embodiment, the return spring extends along a first spiral path from the force-receiving portion, the radius of the first spiral path increasing along at least a portion of the first spiral path, and the actuator extends along a second spiral path from the force-receiving portion.

In accordance with a further embodiment, the assembly has a frame, the plunger being guided by the frame for movement from the extended position to the depressed position. The frame is hollow and contains the one piece member and the reaction portion of the return spring is secured to the frame.

In accordance with a further embodiment, a key switch assembly is provided on a switch site and the reaction portion of the return spring is supported by a support member which is part of the switch. In accordance with a further embodiment, the invention comprises a one piece member as described above which is used in the manufacture of keyboard switch assemblies.

Figure 4:
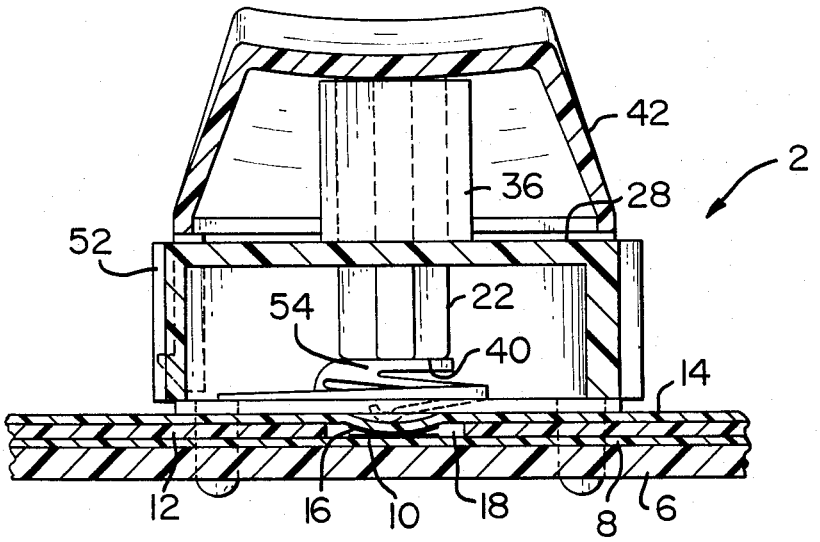
FIG. 4 is a view similar to FIG. 3 showing the positions of the parts when the plunger is in the depressed position.

The drawing shows a key switch assembly 2 in accordance with the invention positioned above a membrane switch site 4 of a membrane switch assembly. The membrane switch assembly comprises a rigid support member 6, a lower membrane or substrate 8 having a switch contact 10 on its upper surface, a separator 12, and upper flexible membrane 14 which has a contact 16 on its lower surface which is opposed to the switch contact or electrode 10. An opening 18 is provided in the separator 12 so that the upper membrane can be flexed downwardly as shown in FIG. 4 to close the switch at the site 4. The zone 19 on the upper membrane 14 above the switch contacts is referred to below as the contact zone in that pressure exerted on this zone will bring about closing of the switch. Ordinarily, a plurality of assemblies 2 will be provided adjacent to each other as on a typewriter type keyboard, for example.

The key switch assembly 2 comprises a frame 20, a plunger 22, and a one piece member 24 which functions as both a return spring and as an actuator for closing the switch. The frame 20 may be of molded plastic material and comprises a housing portion 26 having a top wall 28 and depending sidewalls 30. The housing is hollow and is open at its lower end so that it can be placed in enclosing relationship to the contact zone 19. Mounting posts 32 extend from the sidewalls 30 and through aligned openings 34 in the membrane switch assembly and in the supporting panel 6. The lower ends of these mounting posts can be flattened as by heat staking to retain the housing in position at the switch site.

A guide column 36 extends upwardly from the top wall 28 and has an opening 38 extending therethrough which conforms to the cross section of the plunger 22, this cross section being X-shaped in the embodiment shown. The plunger has a lower or leading end 40 and has a key top 42 on its upper end. This key top has depending retaining arms 44 which have hook-like free ends 46. The arms 44 are received in guide slots 50 in the sidewalls 30 which extend to the upper surface of the top wall 28 as shown at 48. The slots 50 open onto the surfaces of the sidewalls 30 and a retaining bar 52 extends across each slot adjacent to the top wall 28 so that the plunger 22 and the key top 42 are retained as part of the assembly and movement of the plunger from its extended position, FIG. 3, to its depressed position, FIG. 4, is permitted.

Figure 1:
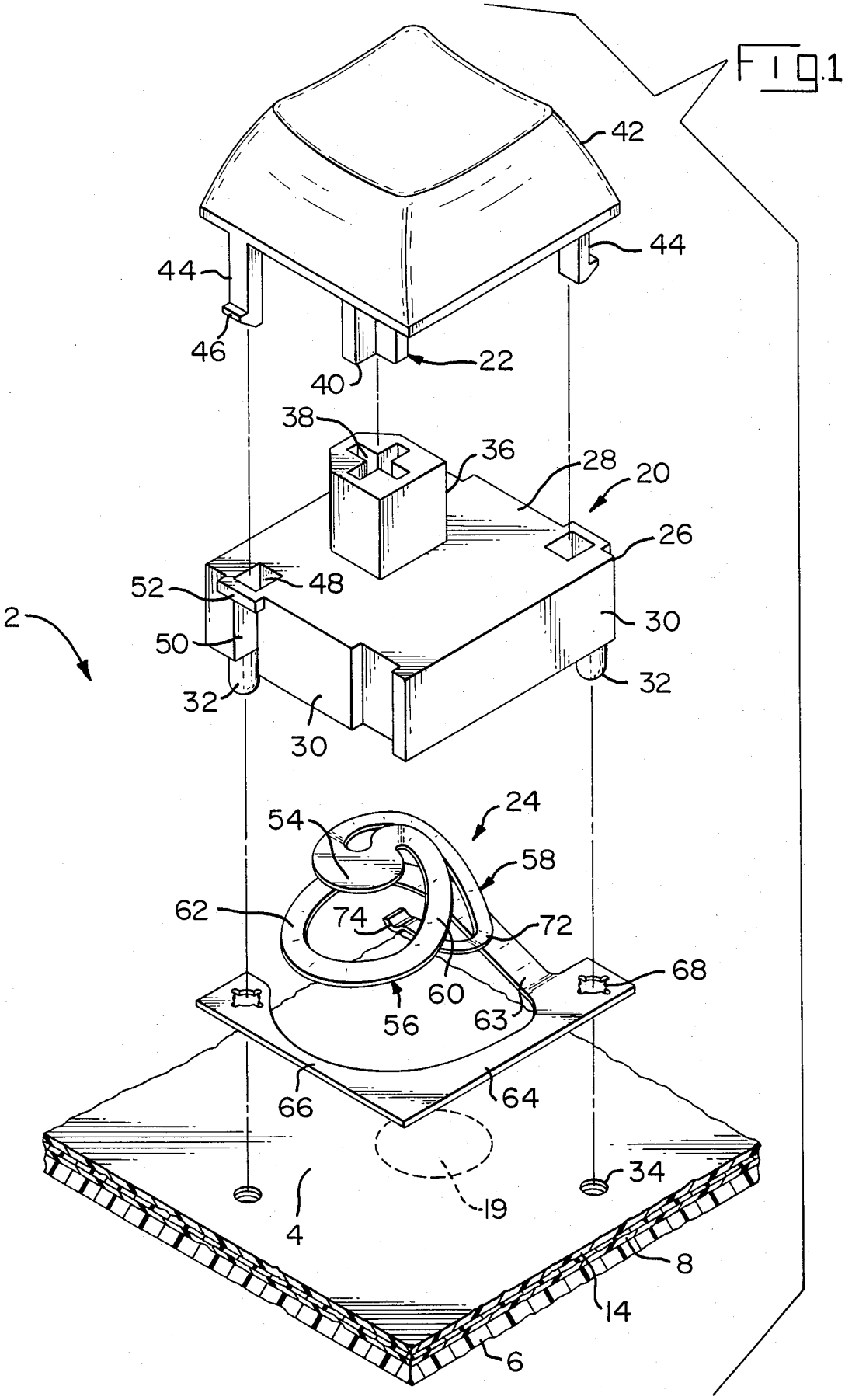
FIG. 1 is a perspective exploded view of a key switch assembly in accordance with the invention located above a switch site.
Figure 2:
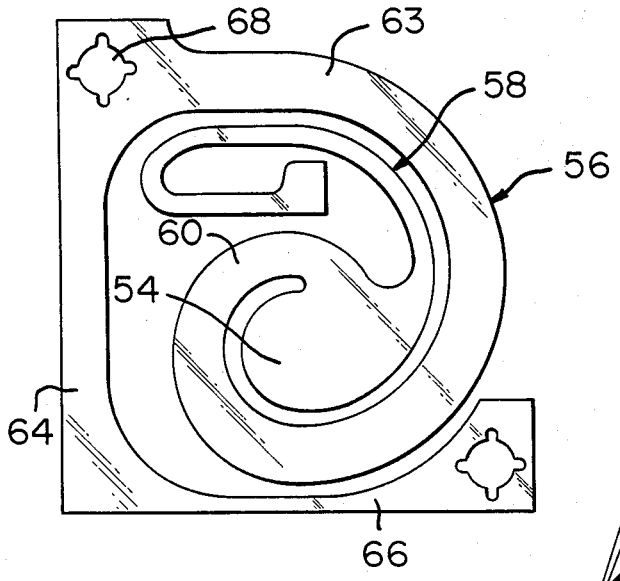
FIG. 2 is a plan view of a flat metal blank from which a one piece member which functions as a return spring and an actuator is formed.
Figure 3:
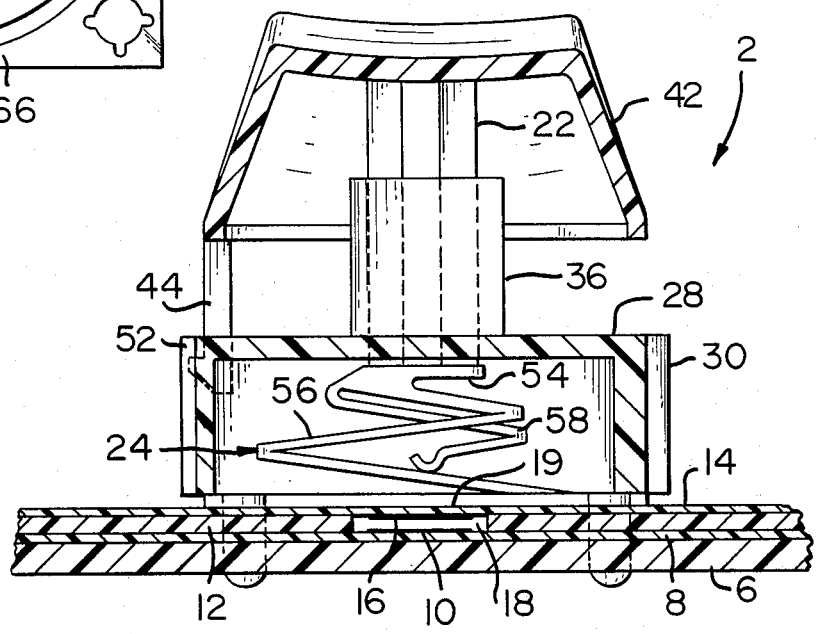
FIG. 3 is a cross-sectional view of a key switch assembly showing the positions of the parts when the plunger is in its extended or normal position.

The one piece member 24 has a flat force-receiving portion 54 which is against the leading end 40 of the plunger when the parts are assembled as shown in FIGS. 3 and 4. An integral return spring 56 and an integral actuator 58 extend from force-receiving portion 54 in a direction away from the leading end 40 of the plunger 22. The return spring 56 extends along a spiral path of increasing radius as shown at 60, 62, and 63 and is integral at 63 with a generally L-shaped reaction portion 64, 66. The reaction portion 64, 66 is so named for the reason that it is supported and receives the reaction force when the plunger is depressed and the spring portion is flexed. The reaction portion has openings 68 therein which receive the mounting posts 32 and thereby anchor the member 24 against movement relative to the housing 26. The intermediate portions of the return spring 60, 62, 63 function as a coil spring when the plunger is depressed and are effective to return the plunger to its normal position after finger pressure on the key tops is released.

The actuator 58 also extends along a generally spiral path from the force-receiving portion 54 and lies between adjacent turns of the return spring 56. The actuator 58 extends in a reverse direction as shown at 72 to its free end 74 which is arcuately formed for engagement with the contact zone 19. As shown in FIG. 3, the reaction portion 64, 66 is spaced from the force-receiving portion 54 by a distance which is greater than the distance between the end 74 of the actuator and the force-receiving portion. These distances are as measured in the direction of movement of the plunger; the force-receiving portion and the free end 74 are also displaced laterally from the axis of the plunger.

The contact zone 19 is offset with relation to the axis of the plunger and the end 74 of the actuator is in alignment with the contact zone so that when the plunger is depressed with accompanying flexure of the return spring 56, the end 74 of the actuator will be moved against the contact zone thereby to close the switch. Preferably, the parts should be dimensioned such that the end 74 of the actuator is against the contact zone prior to arrival of the plunger at its fully depressed position so that there will be some over-travel of the plunger to insure closing of the switch.

The one piece member 24 should be made of a sheet metal having good spring properties such as a stainless steel for maximum spring life, however, the one piece member may be of a suitable plastic material if only a short life is expected from this member. In the embodiment shown, this member 24 is not part of the circuit of the switch, however, if desired, a pair of spaced apart electrodes can be provided on one substrate and the end 74 of the actuator can be designed to move against these electrodes thereby closing the switch.

An advantage of the invention is that only a single part, the member 24, is required for both the actuator and the springs as compared with prior art devices. A further important advantage is that the assembly process is greatly simplified in that it is merely necessary to insert the mounting post 32 through the opening 68 and then assemble the housing to the switch site. If desired, a plurality of individual members 24 can be provided from a single sheet of resilient sheet metal with the members 24 located in positions corresponding to the positions of the switch sites on the keyboard being manufactured. This single sheet of metal can then be assembled to the upper membrane and the housings assembled to the sheet of spring members.

I claim:

1. A key switch assembly of the type comprising a plunger, a return spring, and an actuator, the plunger being movable from an extended position to a depressed position with accompanying flexure of the return spring, the actuator being normally spaced from a switch contact zone and being movable against the contact zone in response to movement of the plunger from the extended position to the depressed position thereby to change the condition of the switch, the return spring being effective to return the plunger to the extended position with accompanying movement of the actuator away from the contact zone, the return spring and the actuator being provided as a one-piece member, the key switch assembly being characterized in that:

the one-piece member has a force-receiving portion which is in engagement with the plunger, the return spring extends away from the force-receiving portion along a spiral path to a reaction portion which bears against a fixed support that is proximate to the switch contact zone, the actuator extends away from the force-receiving portion towards the reaction portion, the actuator having a free end and having a contact portion on the free end which is engageable with the switch contact zone, the contact portion being between the force-receiving portion and the reaction portion when the plunger is in its extended position, the return spring extending along a first spiral path from the force-receiving portion, the radius of the first spiral path increasing along at least a portion of the first spiral path, the actuator extending along a second spiral path from the force-receiving portion to a reversed portion adjacent to its free end, the actuator being entirely between adjacent turns of the return spring whereby upon movement of the plunger from the extended position to the depressed position, the return spring is resilienty flexed and the contact portion of the actuator is moved against the contact zone thereby to change the condition of the switch.

2. A key switch assembly as set forth in claim 1 characterized in that the one-piece member is of spring metal.

3. A key switch assembly as set forth in claim 1 characterized in that the one-piece member is separate from the plunger, the plunger having a leading end, the force-receiving portion of the one-piece member being against the leading end of the plunger.

4. A key switch assembly as set forth in claim 1 characterized in that the assembly has a frame, the plunger being guided by the frame for movement from the extended position to the depressed position.

5. A key switch assembly as set forth in claim 4 characterized in that the frame is hollow and contains the one-piece member.

6. A key switch assembly as set forth in claim 5 characterized in that the reaction portion of the return spring is secured to the frame.

* * * * *